US012781351B2

(12) United States Patent
Moloney et al.

(10) Patent No.: US 12,781,351 B2
(45) Date of Patent: Nov. 3, 2026

(54) COMPOSITIONS AND METHODS FOR METAL WEAR LOSS INHIBITION

(71) Applicant: ChampionX LLC, Sugar Land, TX (US)

(72) Inventors: Jeremy Moloney, Katy, TX (US); Alex Koerner, Dickinson, SD (US); Christopher Longie, Minot, ND (US)

(73) Assignee: ChampionX LLC, Sugar Land, TX (US)

( * ) Notice: Subject to any disclaimer, the term of this patent is extended or adjusted under 35 U.S.C. 154(b) by 529 days.

(21) Appl. No.: 18/361,131

(22) Filed: Jul. 28, 2023

(65) Prior Publication Data

US 2024/0044016 A1 Feb. 8, 2024

Related U.S. Application Data

(60) Provisional application No. 63/369,775, filed on Jul. 29, 2022.

(51) Int. Cl.
*C23F 11/12* (2006.01)
*C23F 11/16* (2006.01)

(52) U.S. Cl.
CPC ..... *C23F 11/128* (2013.01); *C23F 11/161* (2013.01); *C23F 11/163* (2013.01)

(58) Field of Classification Search
None
See application file for complete search history.

(56) References Cited

U.S. PATENT DOCUMENTS 3,980,330 A 9/1976 Walker
4,323,476 A 4/1982 Helwerth et al.
4,440,666 A 4/1984 Miller et al.
4,713,184 A 12/1987 Zaid
5,182,037 A 1/1993 Pialet et al.
5,411,670 A * 5/1995 Walker ..... C23F 11/04 507/131
5,531,937 A 7/1996 Minevski et al.
5,785,895 A 7/1998 Martin et al.
5,853,619 A * 12/1998 Watson ..... C23F 11/10 422/12
6,395,225 B1 5/2002 Pou et al.
6,866,797 B1 3/2005 Martin et al.
7,900,590 B2 3/2011 Cleveland et al.
8,598,099 B2 12/2013 Tipton et al.
8,940,227 B2 1/2015 Hellberg et al.
10,059,872 B2 8/2018 Janak et al.
10,246,629 B2 4/2019 Gill
10,604,710 B2 * 3/2020 Moloney ..... C23F 11/164
10,988,671 B2 4/2021 Obot et al.
11,203,811 B2 12/2021 Crabtree et al.
2002/0107151 A1 * 8/2002 Ahn ..... C23F 11/10 508/564
2004/0167040 A1 8/2004 Dahlmann et al.
2008/0103072 A1 * 5/2008 Vinci ..... C10M 141/10 508/435
2009/0065736 A1 3/2009 Johnson et al.
2011/0214864 A1 9/2011 Maghrabi et al.
2011/0287989 A1 11/2011 Filippini
2013/0196884 A1 * 8/2013 Kakadjian ..... C09K 8/805 507/203
2013/0205654 A1 8/2013 Peretolchin et al.
2013/0303411 A1 11/2013 Wagle et al.
2015/0005210 A1 * 1/2015 Jones ..... C10M 169/04 508/287
2016/0017250 A1 * 1/2016 Bartley ..... C10M 133/16 508/463
2016/0230078 A1 * 8/2016 Pou ..... C23F 11/161
2017/0073604 A1 * 3/2017 Saccomando ..... C10M 137/105
2017/0137634 A1 * 5/2017 Balasubramanian ..... C23F 11/173
2017/0204347 A1 * 7/2017 Marcella ..... F02B 75/02
2017/0247798 A1 * 8/2017 Moloney ..... C23F 11/145
2018/0148632 A1 * 5/2018 Bennett ..... C23G 1/088
2019/0031944 A1 * 1/2019 Mandal ..... C23F 11/141
2019/0040335 A1 2/2019 Di Maio et al.
2019/0085256 A1 3/2019 Kumar et al.
2019/0127640 A1 * 5/2019 Moloney ..... C09K 8/54
2019/0203149 A1 7/2019 Agrawal et al.
2019/0292481 A1 * 9/2019 Galic Raguz ..... C10M 163/00
2019/0376000 A1 12/2019 Buzdygon et al.
2020/0199481 A1 6/2020 Baum et al.
2020/0231891 A1 * 7/2020 Walker ..... C10M 129/10
2020/0283913 A1 * 9/2020 Jackson ..... C23F 11/02
2021/0147760 A1 * 5/2021 Vincent ..... C10M 135/10
2021/0253938 A1 8/2021 Meng et al.
2023/0323188 A1 10/2023 Gon et al.
2025/0109503 A1 * 4/2025 Wu ..... C23F 11/10
2025/0354050 A1 * 11/2025 Rana ..... C09K 8/54

FOREIGN PATENT DOCUMENTS

CN 110344063 A 10/2019
CN 111945168 B 5/2022
CN 111826658 B 8/2022
RU 2096525 C1 11/1997

OTHER PUBLICATIONS

International Search Report and Written Opinion in PCT/US2024/053189, mailed Feb. 12, 2025, 11 pages.

* cited by examiner

*Primary Examiner* — Joseph D Anthony
(74) *Attorney, Agent, or Firm* — McKee, Voorhees & Sease, PLC

(57) ABSTRACT

Methods for reducing, inhibiting or preventing both corrosion and metal wear inhibition of metal surfaces used in recovery, transportation, refining or storage of a hydrocarbon fluids are provided.

18 Claims, No Drawings

COMPOSITIONS AND METHODS FOR METAL WEAR LOSS INHIBITION

CROSS REFERENCE TO RELATED APPLICATIONS

This application claims priority under 35 U.S.C. § 119 to provisional patent application U.S. Ser. No. 63/369,775, filed Jul. 29, 2022. The provisional patent application is herein incorporated by reference in its entirety, including without limitation, the specification, claims, and abstract, as well as any figures, tables, appendices, or drawings thereof.

TECHNICAL FIELD

The disclosure relates generally to methods for reducing, inhibiting or preventing both corrosion and metal wear inhibition of metal surfaces used in recovery, transportation, refining or storage of a hydrocarbon fluids with corrosion and metal wear inhibiting compositions.

BACKGROUND

Carbon steel pipelines, downhole tubulars and surfaces contacting fluids containing water and acidic gases such as carbon dioxide and hydrogen sulfide can result in corrosion and associated problems. The presence of other species such as oxygen, solids, bacteria, elemental sulfur and/or polysulfides, etc. can exacerbate the corrosive conditions and make assets difficult to protect against corrosion. Typically, such systems are protected from general and localized corrosion by adding various corrosion inhibitor compositions and often large quantities of solvents to dissolve sulfur. However, corrosion inhibitor compositions and solvents can be expensive and if used in large quantities can give rise to various issues in the production system such as emulsification and foaming problems. In addition, these pipelines and other metal surfaces, such as in wells, can require downtime, repair costs, and deferred production when premature failures result from metal loss from both corrosion and metal wear, such as from rod and tubing parts rubbing against each other in normal processing conditions.

Thus, there exists a need in the art for enhanced treatments and treatment compositions for reducing, inhibiting or preventing both corrosion and metal wear inhibition of metal surfaces used in recovery, transportation, refining or storage of hydrocarbon fluids.

It is therefore an object of the disclosure to provide methods of reducing, inhibiting or preventing both corrosion and metal wear inhibition of metal surfaces used in recovery, transportation, refining or storage of hydrocarbon fluids.

It is further object of the disclosure to provide methods of reducing, inhibiting or preventing both corrosion and metal wear inhibition of such metal surfaces with a single treatment composition.

It is a further object of the disclosure to provide methods and treatment compositions that provide at least about a 25% wear metal loss rate reduction and wear-corrosion metal loss rate reduction, and preferably provide at least about a 50% wear metal loss rate reduction and wear-corrosion metal loss rate reduction.

Other objects, embodiments and advantages of this disclosure will be apparent to one skilled in the art in view of the following disclosure, the drawings, and the appended claims.

BRIEF SUMMARY

The following objects, features, advantages, aspects, and/or embodiments, are not exhaustive and do not limit the overall disclosure. No single embodiment need provide each and every object, feature, or advantage. Any of the objects, features, advantages, aspects, and/or embodiments disclosed herein can be integrated with one another, either in full or in part.

According to aspects of the present disclosure, methods of reducing, inhibiting or preventing both corrosion and metal wear inhibition of a metal surface comprise: contacting a metal surface with a corrosion and metal wear inhibiting composition to reduce, inhibit or prevent both corrosion and metal wear of the metal surface, wherein the corrosion and metal wear inhibiting composition comprises (a) a carboxylic acid, a salt of a fatty acid amine condensate, and/or an alkanolamine or salt thereof, (b) an organic sulfur compound and/or an organic sulfonic acid amine, and (c) a solvent, and wherein the metal surface is used in recovery, transportation, refining or storage of a hydrocarbon fluid.

In embodiments the corrosion and metal wear inhibiting composition comprises from about 2 wt-% to about 40 wt-% of a carboxylic acid, a salt of fatty acid-amine condensate, and/or an alkanolamine or salt thereof, from about 1 wt-% to about 15 wt-% of an organic sulfur compound and/or an organic sulfonic acid amine, and from about 50 wt-% to about 90 wt-% of a solvent. In further embodiments the corrosion and metal wear inhibiting composition further comprises from about 0 wt-% to about 40 wt-% of additional functional ingredients comprising a substituted aromatic amine, a phosphoric acid ester, quaternary ammonium compounds, a solvent stabilizer compound comprising a glycol ether, a demulsifier, a carboxylic acid, at least one surfactant, other corrosion inhibitors, corrosion inhibitor intensifiers, pH modifier, pH control additives, surfactants, gas hydrate inhibitors, scale inhibitors, clay stabilizers, bactericides, biocides, salt substitutes, relative permeability modifiers, hydrogen sulfide scavengers, oxygen scavengers, breakers, fluid loss control additives, asphaltene inhibitors, paraffin inhibitors, chelating agents, foaming agents, defoamers, emulsifiers, demulsifiers, iron control agents, friction reducers, drag reducing agents, flow improvers, viscosity reducers, solvents, etc. or combinations thereof.

While multiple embodiments are disclosed, still other embodiments will become apparent to those skilled in the art from the following detailed description, which shows and describes illustrative embodiments. Accordingly, the drawings and detailed description are to be regarded as illustrative in nature and not restrictive.

DETAILED DESCRIPTION

The present disclosure is not to be limited to that described herein, which can vary and are understood by skilled artisans. No features shown or described are essential to permit basic operation of the present disclosure unless otherwise indicated. It has been surprisingly found that corrosion and metal wear inhibiting compositions comprising a carboxylic acid and/or a salt of fatty acid amine condensate, an alkanolamine or salt thereof, an organic sulfur compound and/or an organic sulfonic acid amine, and a solvent reduce, inhibit or prevent both corrosion and metal wear inhibition of metal surfaces used in recovery, transportation, refining or storage of a hydrocarbon fluids.

It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form.

Numeric ranges recited within the specification are inclusive of the numbers defining the range and include each integer within the defined range. Throughout this disclosure, various aspects of this disclosure are presented in a range format. It should be understood that the description in range format is merely for convenience and brevity and should not be construed as an inflexible limitation on the scope of the disclosure. Accordingly, the description of a range should be considered to have specifically disclosed all the possible sub-ranges, fractions, and individual numerical values within that range. For example, description of a range such as from 1 to 6 should be considered to have specifically disclosed sub-ranges such as from 1 to 3, from 1 to 4, from 1 to 5, from 2 to 4, from 2 to 6, from 3 to 6 etc., as well as individual numbers within that range, for example, 1, 2, 3, 4, 5, and 6, and decimals and fractions, for example, 1.2, 3.8, 1½, and 4¾. This applies regardless of the breadth of the range.

As used herein, the term "and/or", e.g., "X and/or Y" shall be understood to mean either "X and Y" or "X or Y" and shall be taken to provide explicit support for both meanings or for either meaning, e.g. A and/or B includes the options i) A, ii) B or iii) A and B.

It is to be appreciated that certain features that are, for clarity, described herein in the context of separate embodiments, may also be provided in combination in a single embodiment. Conversely, various features that are, for brevity, described in the context of a single embodiment, may also be provided separately or in any sub-combination.

The methods and compositions of the present disclosure may comprise, consist essentially of, or consist of the components and ingredients of the present disclosure as well as other ingredients described herein. As used herein, "consisting essentially of" means that the methods, systems, apparatuses and compositions may include additional steps, components or ingredients, but only if the additional steps, components or ingredients do not materially alter the basic and novel characteristics of the claimed methods, systems, apparatuses, and compositions.

Unless defined otherwise, all technical and scientific terms used above have the same meaning as commonly understood by one of ordinary skill in the art to which embodiments of the present disclosure pertain.

The terms "invention" or "present invention" are not intended to refer to any single embodiment of the particular invention but encompass all possible embodiments as described in the specification and the claims.

The term "about," as used herein, refers to variation in the numerical quantity that can occur, for example, through typical measuring techniques and equipment, with respect to any quantifiable variable, including, but not limited to, mass, volume, time, temperature, pH, and other measurements. The term "about" encompasses these variations. Whether or not modified by the term "about," the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts. It is also sometimes indicated by a percentage in parentheses, for example, "chemical (10%)."

As used herein, the term "alkyl" or "alkyl groups" refers to saturated hydrocarbons having one or more carbon atoms, including straight-chain alkyl groups (e.g., methyl, ethyl, propyl, butyl, pentyl, hexyl, heptyl, octyl, nonyl, decyl, etc.), cyclic alkyl groups (or "cycloalkyl" or "alicyclic" or "carbocyclic" groups) (e.g., cyclopropyl, cyclopentyl, cyclohexyl, cycloheptyl, cyclooctyl, etc.), branched-chain alkyl groups (e.g., isopropyl, tert-butyl, sec-butyl, isobutyl, etc.), and alkyl-substituted alkyl groups (e.g., alkyl-substituted cycloalkyl groups and cycloalkyl-substituted alkyl groups). Unless otherwise specified, the term "alkyl" includes both "unsubstituted alkyls" and "substituted alkyls." As used herein, the term "substituted alkyls" refers to alkyl groups having substituents replacing one or more hydrogens on one or more carbons of the hydrocarbon backbone. Such substituents may include, for example, alkenyl, alkynyl, halogeno, hydroxyl, alkylcarbonyloxy, arylcarbonyloxy, alkoxycarbonyloxy, aryloxy, aryloxycarbonyloxy, carboxylate, alkylcarbonyl, arylcarbonyl, alkoxycarbonyl, aminocarbonyl, alkylaminocarbonyl, dialkylaminocarbonyl, alkylthiocarbonyl, alkoxyl, phosphate, phosphonato, phosphinato, cyano, amino (including alkyl amino, dialkylamino, arylamino, diarylamino, and alkylarylamino), acylamino (including alkylcarbonylamino, arylcarbonylamino, carbamoyl and ureido), imino, sulfhydryl, alkylthio, arylthio, thiocarboxylate, sulfates, alkylsulfinyl, sulfonates, sulfamoyl, sulfonamido, nitro, trifluoromethyl, cyano, azido, heterocyclic, alkylaryl, or aromatic (including heteroaromatic) groups. In some embodiments, substituted alkyls can include a heterocyclic group. As used herein, the term "heterocyclic group" includes closed ring structures analogous to carbocyclic groups in which one or more of the carbon atoms in the ring is an element other than carbon, for example, nitrogen, sulfur or oxygen. Heterocyclic groups may be saturated or unsaturated. Exemplary heterocyclic groups include, but are not limited to, aziridine, ethylene oxide (epoxides, oxiranes), thiirane (episulfides), dioxirane, azetidine, oxetane, thietane, dioxetane, dithietane, dithiete, azolidine, pyrrolidine, pyrroline, oxolane, dihydrofuran, and furan.

Terms characterizing sequential order, a position, and/or an orientation are not limiting and are only referenced according to the views presented.

As used herein, the term "exemplary" refers to an example, an instance, or an illustration, and does not indicate a most preferred embodiment unless otherwise stated.

As used herein, the term "free" refers to compositions completely lacking the component or having such a small amount of the component that the component does not affect the performance of the composition. The component may be present as an impurity or as a contaminant and shall be less than 0.1 wt-%, less than 0.01 wt-%, or 0 wt-%.

The term "generally" encompasses both "about" and "substantially."

As used herein the term "polymer" refers to a molecular complex comprised of a more than ten monomeric units and generally includes, but is not limited to, homopolymers, copolymers, such as for example, block, graft, random and alternating copolymers, terpolymers, and higher "x"mers, further including their analogs, derivatives, combinations, and blends thereof. Furthermore, unless otherwise specifically limited, the term "polymer" shall include all possible isomeric configurations of the molecule, including, but are not limited to isotactic, syndiotactic and random symmetries, and combinations thereof. Furthermore, unless otherwise specifically limited, the term "polymer" shall include all possible geometrical configurations of the molecule.

The "scope" of the present disclosure is defined by the appended claims, along with the full scope of equivalents to which such claims are entitled. The scope of the disclosure is further qualified as including any possible modification to any of the aspects and/or embodiments disclosed herein which would result in other embodiments, combinations, subcombinations, or the like that would be obvious to those skilled in the art.

The term "substantially" refers to a great or significant extent. "Substantially" can thus refer to a plurality, majority, and/or a supermajority of said quantifiable variable, given proper context.

As used herein, the term "substantially free" refers to compositions completely lacking the component or having such a small amount of the component that the component does not affect the performance of the composition. The component may be present as an impurity or as a contaminant and shall be less than 0.5 wt-%. In another embodiment, the amount of the component is less than 0.1 wt-% and in yet another embodiment, the amount of component is less than 0.01 wt-%.

The term "surfactant" or "surface active agent" refers to an organic chemical that when added to a liquid changes the properties of that liquid at a surface.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc. The recitation of wt-% of the components may or may not have a percent actives of 100%, as they refer to the total weight percentage of the raw materials (i.e. active concentration plus inert ingredients).

Corrosion and Metal Wear Inhibiting Compositions

According to embodiments, the corrosion and metal wear inhibiting compositions comprise a carboxylic acid and/or a salt of a fatty acid amine condensate, an alkanolamine or salt thereof, an organic sulfur compound and/or an organic sulfonic acid amine, and a solvent. The compositions can include additional functional ingredients and can be provided as concentrate or use compositions.

Carboxylic Acid, Salt of a Fatty Acid Amine Condensate and/or Alkanolamine or Salt Thereof The corrosion and metal wear inhibiting compositions comprise a carboxylic acid, a salt of a fatty acid amine condensate, and/or an alkanolamine or salt thereof. In some embodiments, the corrosion and metal wear inhibiting compositions comprise at least two of a carboxylic acid, a salt fatty acid amine condensate, and/or an alkanolamine or salt thereof. In further embodiments, the corrosion and metal wear inhibiting compositions comprise a carboxylic acid, a salt fatty acid amine condensate, and an alkanolamine or salt thereof.

In some embodiments, the carboxylic acid, salt of a fatty acid amine condensate, and/or an alkanolamine or salt thereof is included in the composition at an amount of at least about 2 wt-% to about 40 wt-%, about 2 wt-% to about 30 wt-%, about 2 wt-% to about 20 wt-%, about 4 wt-% to about 30 wt-%, about 5 wt-% to about 30 wt-%, about 5 wt-% to about 25 wt-%, or about 5 wt-% to about 20 wt-%. In addition, without being limited according to the disclosure, all ranges recited are inclusive of the numbers defining the range and include each integer within the defined range.

In some embodiments, the carboxylic acid is included in the composition at an amount of at least about 0.1 wt-% to about 10 wt-%, about 0.1 wt-% to about 8 wt-%, about 0.1 wt-% to about 6 wt-%, about 0.1 wt-% to about 4 wt-%, or about 0.1 wt-% to about 2 wt-%, the salt of a fatty acid amine condensate is included in the composition at an amount of at least about 2 wt-% to about 40 wt-%, about 2 wt-% to about 30 wt-%, about 2 wt-% to about 25 wt-%, about 2 wt-% to about 20 wt-%, about 2 wt-% to about 15 wt-%, or about 2 wt-% to about 10 wt-%, and/or the an alkanolamine or salt thereof is included in the composition at an amount of at least about 2 wt-% to about 40 wt-%, about 2 wt-% to about 30 wt-%, about 2 wt-% to about 25 wt-%, about 2 wt-% to about 20 wt-%, about 2 wt-% to about 15 wt-%, or about 2 wt-% to about 10 wt-%. In addition, without being limited according to the disclosure, all ranges recited are inclusive of the numbers defining the range and include each integer within the defined range.

Salts of Fatty Acid Amine Condensates

Fatty acid amine condensates are the reaction products produced by reacting fatty acids with amines. Any amine may be used and any fatty acid may be used. Illustrative, non-limiting examples of fatty acids are carboxylic acids with long hydrocarbon chains, the hydrocarbon chains generally having from about 10 to about 30 carbon atoms. The fatty acids may be both saturated and unsaturated.

Exemplary salts of fatty acid amine condensates can include for example, carboxylic acid-polyamine condensates, carboxylic acid alkanolamine salts, such as dicarboxylic acid diethanolamine salts, and reaction products of (1) a polyunsaturated fatty acid dimer, (2) a sulfonic acid compound, and (3) a reaction product of a polyalkylene polyamine, a tall oil fatty acid, and a polyunsaturated fatty acid dimer. A preferred salt of a fatty acid amine condensate is commercially available as tall oil acid, dimeric linoleic acid, poly C2-C4 alkylene polyamine condensate, dodecylbenzene sulfonic acid, dimeric linoleic acid salts (CAS 68910-85-0).

In embodiments where the salts of fatty acid amine condensates are carboxylic acid-polyamine condensates, examples include naphthenic acid reaction products with Diethylenetriamine and Tall Oil Fatty Acids. These also include imidazolines. Imidazolines can be, for example, imidazoline derived from a diamine, such as ethylene diamine (EDA), diethylene triamine (DETA), triethylene tetraamine (TETA), aminoethylethanolamine (AEEA), tetraethylenepentamine (TEPA), etc. and a long chain fatty acid such as tall oil fatty acid (TOFA). These can be further reacted with various acids including acetic, acrylic, etc. The imidazoline can be an imidazoline of Formula (1A) or an imidazoline derivative.

(1A)

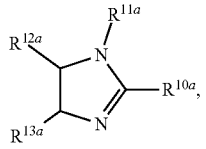

wherein $R^{10a}$ is a $C_1$-$C_{20}$ alkyl or a $C_1$-$C_{20}$ alkoxyalkyl group; $R^{11a}$ is hydrogen, $C_1$-$C_6$ alkyl, $C_1$-$C_6$ hydroxyalkyl, or $C_1$-$C_6$ arylalkyl; and $R^{12a}$ and $R^{13a}$ are independently hydrogen or a $C_1$-$C_6$ alkyl group. Preferably, the imidazoline includes an $R^{10a}$ which is the alkyl mixture typical in tall oil fatty acid (TOFA), and $R^{11a}$, $R^{12a}$ and $R^{13a}$ are each hydrogen.

Representative imidazoline derivatives include an imidazolinium compound of Formula (2A) or a bis-quaternized compound of Formula (3A), each shown below:

(2A)

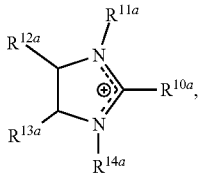

wherein $R^{10a}$ is a $C_1$-$C_{20}$ alkyl or a $C_1$-$C_{20}$ alkoxyalkyl group; $R^{11a}$ and $R^{13a}$ are independently hydrogen, $C_1$-$C_6$ alkyl, $C_1$-$C_6$ hydroxyalkyl, or $C_1$-$C_6$ arylalkyl; and $R^{12a}$ and $R^{14a}$ are independently hydrogen or a $C_1$-$C_6$ alkyl group. Preferably, the imidazoline includes an $R^{10a}$ which is the alkyl mixture typical in tall oil fatty acid (TOFA), and $R^{11a}$, $R^{12a}$ and $R^{13a}$ are each hydrogen. Preferably, the imidazolinium compound includes 1-benzyl-1-(2-hydroxyethyl)-2-tall-oil-2-imidazolinium chloride, or (3A)

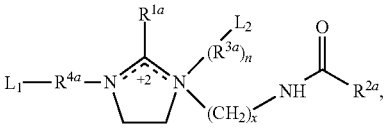

wherein:

$R^{1a}$ and $R^{2a}$ are each independently unsubstituted branched, chain or ring alkyl or alkenyl having from 1 to about 29 carbon atoms; partially or fully oxygenized, sulfurized, and/or phosphorylized branched, chain, or ring alkyl or alkenyl having from 1 to about 29 carbon atoms; or a combination thereof;

$R^{3a}$ and $R^{4a}$ are each independently unsubstituted branched, chain or ring alkylene or alkenylene having from 1 to about 29 carbon atoms; partially or fully oxygenized, sulfurized, and/or phosphorylized branched, chain, or ring alkylene or alkenylene having from 1 to about 29 carbon atoms; or a combination thereof;

$L_1$ and $L_2$ are each independently absent, H, —COOH, —$SO_3H$, —$PO_3H_2$, —$COOR^{5a}$, —$CONH_2$, —$CONHR^{5a}$, or —$CON(R^{5a})_2$;

$R^{5a}$ is each independently a branched or unbranched alkyl, aryl, alkylaryl, alkylheteroaryl, cycloalkyl, or heteroaryl group having from 1 to about 10 carbon atoms;

n is 0 or 1, and when n is 0, $L_2$ is absent or H;

x is from 1 to about 10; and y is from 1 to about 5.

In embodiments where the salts of fatty acid amine condensates are carboxylic acid alkanolamine salts, which can include substituted aromatic amine can comprise an alkyl pyridine such as 3,5-diethyl-2-methylpyridine or 3-ethyl-4-methylpyridine, or other substituted pyridines such as (E)-5-ethyl-2-(prop-1-en-1-yl)pyridine, (E)-5-(but-2-en-1-yl)-2-methylpyridine, or N-ethyl-2-(6-methylpyridin-3-yl)ethanamine. An example employed in compositions described herein this disclosure include dicarboxylic acid diethanolamine salts, such as 2-cyclohexene-1-octanoic acid, 5(or 6)-carboxy-4-hexyl-, compd. with 2,2'iminobis (ethanol).

In embodiments where the salts of fatty acid amine condensates are a reaction product of (1) a polyunsaturated fatty acid dimer, (2) a sulfonic acid compound, and (3) a reaction product of a polyalkylene polyamine, a tall oil fatty acid, and a polyunsaturated fatty acid dimer, the polyunsaturated fatty acid dimer (or the polyunsaturated fatty acid dimer of the reaction product (3) above) can independently comprise a dimer of linoleic acid, gamma-linolenic acid (GLA), eicosadienoic acid, dihomo-gamma-linolenic acid (DLGA), arachidonic acid (AA), docosadienoic acid, adrenic acid, docosapentaenoic acid, tetracosatetraenoic acid, tetracosapentaenoic acid, hexadecatrienoic acid (HTA), alpha-linolenic acid (ALA), stearidonic acid (SDA), eicosatrienoic acid (ETE), eicosatetraenoic acid (ETA), eicosapentaenoic acid (EPA), heneicosapentaenoic acid (HPA), docosapentaenoic acid (DPA), docosahexaenoic acid (DHA), tetracosapentaenoic acid, tetracosahexaenoic acid, mead acid, or a combination thereof. Preferably, the polyunsaturated fatty acid dimer comprises linoleic acid dimer.

The sulfonic acid compound can comprise an organic sulfonic acid. The organic sulfonic acid can be an aryl sulfonic acid including, but not limited to, a linear alkylbenzenesulfonic acid, a branched alkylbenzenesulfonic acid, or other substituted or unsubstituted aromatic sulfonic acid. Suitable aryl sulfonic acids include, but are not limited to, methylbenzene sulfonic acid (e.g., p-toluenesulfonic acid), ethylbenzene sulfonic acid, butylbenzene sulfonic acid, octylbenzene sulfonic acid, dodecylbenzene sulfonic acid, and 2-naphthalene sulfonic acid. Preferably, the sulfonic acid compound comprises a linear alkyl benzene sulfonic acid such as dodecylbenzene sulfonic acid.

The organic sulfonic acid can also comprise an alkyl sulfonic acid or an arylalkyl sulfonic acid including, but not limited to methanesulfonic acid, trifluoromethanesulfonic acid, DL-camphorsulfonic acid, and phenylmethanesulfonic acid.

The organic sulfonic acid can include a monosulfonic acid, a disulfonic acid, or a polysulfonic acid. Suitable disulfonic acids include, but are not limited to, benzenedisulfonic acid, napthalenedisulfonic acid, 2,3-dimethyl-1,4-benzenedisulfonic acid, 2,4-dimethyl-1,3-benzenedisulfonic acid, 2,5-dimethyl-1,3-benzenedisulfonic acid, 2,5-dimethyl-1,4-benzenedisulfonic acid, 3,6-dimethyl-1,2-benzenedisulfonic acid, or a combination thereof. Suitable polysulfonic acids include, but are not limited to, benzene trisulfonic acid, naphthalene trisulfonic acid, 1,3,6-napthalenetrisulfonic acid, 1-nitronaphthalene-3,6,8-trisulfonic acid, or a combination thereof.

The polyalkylene polyamine of the reaction product (3) above can include, but is not limited to, a polyethylene polyamine, a polypropylene polyamine, a polybutylene polyamine, and a combination thereof. Preferably, the polyalkylene polyamine comprises a combination of polyethylene polyamine, polypropylene polyamines, and polybutylene polyamines.

Suitable polyethylene polyamines include, but are not limited to, diethylene triamine (DETA), triethylene tetramine (TETA), tetraethylene pentamine (TEPA), pentaethylene hexamine (PEHA), hexaethylene heptamine (HEHA), and higher homologues.

Suitable polypropylene polyamines include, but are not limited to, dipropylene triamine, tripropylene tetramine, tetrapropylene pentamine, pentapropylene hexamine, hexapropylene heptamine, and higher homologues.

Suitable polybutylene polyamines include, but are not limited to, dibutylene triamine, tributylene tetramine, tetrabutylene pentamine, pentabutylene hexamine, hexabutylene heptamine, and higher homologues.

Other suitable polyalkylene polyamines include bis(hexamethylene)triamine, N,N'-bis(3-aminopropyl)ethylenediamine, spermidine, and spermine.

It will be recognized by those skilled in the art that polyalkylene polyamines containing four or more nitrogen atoms are generally available as mixtures of linear, branched, and cyclic compounds, most of which contain the same number of nitrogen atoms. For example, triethylene tetramine (TETA) contains not only linear TETA, but also tris(aminoethyl)amine, N,N'-bis(2-aminoethyl)piperazine, and N-[(2-aminoethyl)-2-aminoethyl]piperazine. Similarly, tetraethylene pentamine is principally a mixture of four TEPA ethyleneamines, including linear, branched, and two cyclic TEPA products.

A suitable polyalkylene polyamine is Ethyleneamine E-100, a commercially available mixture of polyethylene polyamines comprising TEPA, PEHA, and HEHA (Huntsman Corporation). Ethyleneamine E-100 typically consists of less than 1.0 wt-% of low molecular weight amine, 10-15 wt-% TEPA, 40-50 wt-% PEHA, and the balance HEHA and higher oligomers. Typically, Ethyleneamine E-100 has total nitrogen content of about 33-34 wt-% and a number average molecular weight of 250-300 g/mole.

A suitable polyamine mixture is Heavy Polyamine X (HPA-X), commercially available from Dow Chemical Company. Heavy Polyamine X is a complex mixture of linear, branched, and cyclic polyethylene polyamines, comprising TETA, TEPA, PEHA, and polyethylene polyamines (CAS No. 68131-73-7 or CAS No. 29320-38-5).

Another suitable polyamine mixture is Amix 1000 (CAS #68910-05-4), commercially available from BASF Corporation. Amix 1000 is a mixture of roughly equivalent amounts of aminoethylethanolamine, triethylene tetramine (TETA), aminoethylpiperazine, and high boiling polyamines.

The tall oil fatty acid of the reaction product (3) above can comprise any tall oil fatty acid including, but not limited to, oleic acid, linoleic acid, abietic acid, neoabietic acid, palustric acid, pimaric acid, dehydroabietic acid, palmitic acid, stearic acid, palm itoleic acid, 5,9,12-octadecatrienoic acid, linolenic acid, 5,II,14-eicosatrenoic acid, cis,cis-5,9-octadecadienoic acid, eicosadienoic acid, elaidic acid, cis-11-octadecanoic acid, or a combination thereof, as well as other $C_{20}$, $C_{22}$, $C_{24}$ saturated acids.

Carboxylic Acids

Carboxylic acids include organic acids having carboxyl group attached to an R-group (R—COOH). In some embodiments, the carboxylic acid is a fatty acid, such as monomeric or oligomeric fatty acid. Exemplary monomeric or oligomeric fatty acids can include saturated and unsaturated fatty acids as well as dimer, trimer and oligomer products obtained by polymerizing one or more of such fatty acids.

Alkanolamine or Salt Thereof

Exemplary alkanolamines or salts thereof can include for example, fatty acid alkanolamines, fatty acid ethanolamines, fatty acid diethanolamines or triethanolamines, such as dicarboxylic acid diethanolamines, and salts thereof.

Organic Sulfur Compound and/or Organic Sulfonic Acid Amine

The corrosion and metal wear inhibiting compositions comprise an organic sulfur compound and/or organic sulfonic acid amine or salt thereof. Organic sulfur compounds include for example, mercaptoalkyl alcohol, mercaptoacetic acid, thioglycolic acid, 3,3'-dithiodipropionic acid, thiosulfate, thiourea, L-cysteine, tert-butyl mercaptan, sodium thiosulfate, ammonium thiosulfate, sodium thiocyanate, ammonium thiocyanate, sodium metabisulfite, or a combination thereof. Preferably, the mercaptoalkyl alcohol comprises 2-mercaptoethanol.

Organic sulfonic acid amines include for example, alkyl or aryl sulfonic acid amines, or salts thereof, such as morpholine dodecylbenzenesulfonate.

In some embodiments, the organic sulfur compound and/or organic sulfonic acid amine is included in the composition at an amount of at least about 1 wt-% to about 15 wt-%, about 1 wt-% to about 10 wt-%, about 2 wt-% to about 10 wt-%, about 1 wt-% to about 8 wt-%, or about 2 wt-% to about 8 wt-%. In addition, without being limited according to the disclosure, all ranges recited are inclusive of the numbers defining the range and include each integer within the defined range.

In some embodiments, the organic sulfur compound is included in the composition at an amount of at least about 0 wt-% to about 10 wt-%, about 1 wt-% to about 10 wt-%, about 1 wt-% to about 8 wt-%, or about 2 wt-% to about 6 wt-%, and/or the organic sulfonic acid amine is included in the composition at an amount of at least about 0 wt-% to about 10 wt-%, about 1 wt-% to about 10 wt-%, about 1 wt-% to about 8 wt-%, or about 2 wt-% to about 6 wt-%. In addition, without being limited according to the disclosure, all ranges recited are inclusive of the numbers defining the range and include each integer within the defined range.

Solvent

The corrosion and metal wear inhibiting compositions comprise a solvent. In embodiments more than one solvent is included in the corrosion and metal wear inhibiting compositions. An exemplary solvent is water, organic solvent and/or aromatic solvents. In various embodiments the primary solvent is water. In some embodiments additional solvents are included in the compositions as solvents from the individual raw materials and/or intermediates including, for example, ethylene glycol, petroleum distillates, heavy aromatic naphtha, isopropanol, 2-butoxyetanol/EGMBE, isobutanol, naphthalene, etc.

Exemplary organic solvents can include an alcohol, a hydrocarbon, a ketone, an ether, an alkylene glycol, a glycol ether, an amide, a nitrile, a sulfoxide, an ester, or a combination thereof. Examples of suitable organic solvents include, but are not limited to, methanol, ethanol, propanol, isopropanol, butanol, 2-ethylhexanol, hexanol, octanol, decanol, 2-butoxyethanol, methylene glycol, ethylene glycol, 1,2-propylene glycol, 1,3-propylene glycol, diethyleneglycol monomethyl ether, diethylene glycol monoethyl ether, ethylene glycol monobutyl ether, ethylene glycol dibutyl ether, pentane, hexane, cyclohexane, methylcyclohexane, heptane, decane, dodecane, diesel, toluene, xylene, heavy aromatic naphtha, cyclohexanone, diisobutylketone, diethyl ether, propylene carbonate, N-methylpyrrolidinone, N,N-dimethylformamide, or a combination thereof.

Exemplary aromatic solvents comprise aromatic hydrocarbons such as toluene, xylene, heavy aromatic naphtha, or a combination thereof. Preferably, the aromatic solvent comprises heavy aromatic naphtha or xylene. In any of the embodiments described the aromatic solvent(s) is preferably combined with water.

In some embodiments, the solvent or combination of solvents is included in the composition at an amount of at least about 50 wt-% to about 90 wt-%, about 60 wt-% to about 90 wt-%, about 65 wt-% to about 90 wt-%, about 70 wt-% to about 90 wt-%, about 75 wt-% to about 90 wt-%, or about 80 wt-% to about 90 wt-%. In addition, without being limited according to the disclosure, all ranges recited are inclusive of the numbers defining the range and include each integer within the defined range.

Additional Functional Ingredients

The components of the corrosion and metal wear inhibiting compositions can further be combined with various functional components suitable for uses disclosed herein. In some embodiments, the compositions including the fatty acid and/or fatty acid amine condensate or salts thereof, alkanolamine or salt thereof, organic sulfur compound and/or an organic sulfonic acid amine, and solvent make up a large amount, or even substantially all of the total weight of the compositions. For example, in some embodiments few or no additional functional ingredients are disposed therein.

In other embodiments, additional functional ingredients may be included in the compositions. The functional ingredients provide desired properties and functionalities to the compositions. For the purpose of this application, the term "functional ingredient" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional ingredients may be used. For example, many of the functional materials discussed below relate to materials used in cleaning. However, other embodiments may include functional ingredients for use in other applications.

In some embodiments, the compositions may include additional corrosion inhibitors, corrosion inhibitor intensifiers, pH control additives, surfactants, scale inhibitors, clay stabilizers, bactericides, salt substitutes, relative permeability modifiers, sulfide scavengers, oxygen scavengers, breakers, fluid loss control additives, asphaltene inhibitors, paraffin inhibitors, chelating agents, foaming agents, defoamers, emulsifiers, demulsifiers, iron control agents, friction reducers, drag reducing agents, flow improvers, viscosity reducers, and solvents, including for examples those disclosed in U.S. Pat. No. 10,604,710, which is herein incorporated by reference in its entirety.

In some embodiments, the compositions may include a substituted aromatic amine, a phosphoric acid ester, quaternary ammonium compounds, a solvent stabilizer compound comprising a glycol ether, a demulsifier, a carboxylic acid, at least one surfactant, other corrosion inhibitors, corrosion inhibitor intensifiers, pH modifier, pH control additives, surfactants, gas hydrate inhibitors, scale inhibitors, clay stabilizers, bactericides, biocides, salt substitutes, relative permeability modifiers, hydrogen sulfide scavengers, oxygen scavengers, breakers, fluid loss control additives, asphaltene inhibitors, paraffin inhibitors, chelating agents, foaming agents, defoamers, emulsifiers, demulsifiers, iron control agents, friction reducers, drag reducing agents, flow improvers, viscosity reducers, solvents, etc. or combinations thereof.

In some embodiments, the compositions are substantially free of, or free of, pyrazine corrosion inhibitors.

According to embodiments of the disclosure, the various additional functional ingredients may be provided in a composition in the amount from about 0 wt-% and about 40 wt-%, from about 0 wt-% and about 30 wt-%, from about 0 wt-% and about 20 wt-%, from about 0.01 wt-% and about 40 wt-%, from about 0.1 wt-% and about 40 wt-%, from about 0.1 wt-% and about 30 wt-%, from about 0.1 wt-% and about 20 wt-%, or from about 1 wt-% and about 2 wt-%, or from about 1 wt-% and about 10 wt-%. In addition, without being limited according to the disclosure, all ranges recited are inclusive of the numbers defining the range and include each integer within the defined range.

Demulsifiers

The corrosion and metal wear inhibiting compositions can optionally comprise a demulsifier. Exemplary demulsifiers include an oxyalkylate polymer (e.g. polyalkylene glycol), dodecylbenzylsulfonic acid, a salt of xylenesulfonic acid, epoxylated/propoxylated compound, phenolic and epoxide resin, or combinations thereof.

In some embodiments, the demulsifier, if included in the composition, is included at an amount of at least about 0.1 wt-% to about 10 wt-%, about 0.5 wt-% to about 10 wt-%, about 0.5 wt-% to about 8 wt-%, about 0.5 wt-% to about 5 wt-%, or about 0.5 wt-% to about 2 wt-%. In addition, without being limited according to the disclosure, all ranges recited are inclusive of the numbers defining the range and include each integer within the defined range.

Solvent Stabilizers

The corrosion and metal wear inhibiting compositions can optionally comprise a solvent stabilizer. Exemplary solvent stabilizers include glycol ethers, including, but not limited to, 2-butoxyethanol, diethyleneglycol monomethyl ether, ethylene glycol monobutyl ether, ethylene glycol monopropyl ether, ethylene glycol dibutyl ether, or a combination thereof. Solvent stabilizers can optionally be included at an amount of at least about 0 wt-% to about 30 wt-%, about 0.5 wt-% to about 20 wt-%, or about 0.5 wt-% to about 10 wt-%. In addition, without being limited according to the disclosure, all ranges recited are inclusive of the numbers defining the range and include each integer within the defined range.

Phosphoric Acid Ester

The corrosion and metal wear inhibiting compositions can optionally comprise a phosphoric acid ester. Exemplary phosphoric acid esters include an alkoxylated alkylphenol phosphate ester. Preferably, the alkoxylated alkylphenol phosphate ester comprises an ethoxylated nonylphenol phosphate ester. Phosphoric acid esters can optionally be included at an amount of at least about 0 wt-% to about 20 wt-%, about 0.5 wt-% to about 20 wt-%, or about 0.5 wt-% to about 10 wt-%. In addition, without being limited according to the disclosure, all ranges recited are inclusive of the numbers defining the range and include each integer within the defined range.

Surfactants

The corrosion and metal wear inhibiting compositions can optionally comprise a cationic surfactant, anionic surfactant and/or nonionic surfactant. Exemplary cationic surfactants that are useful in corrosion inhibiting compositions and methods of use include but is not limited to, alkoxylated alkyl amines, quaternary ammonium compounds, and/or the like.

The alkoxylated alkyl amine can comprise an ethoxylated alkyl amine such as ethoxylated tallow amine.

Any quaternary ammonium compounds may be used. Illustrative, non-limiting examples of suitable quaternary ammonium compounds are selected from benzyldimethyldodecylammonium chloride, benzyldimethyltetradecylammonium chloride, benzyldimethylhexadecylammonium chloride, benzyldimethyloctadecyl ammonium chloride, and any combination thereof.

In some embodiments, the quaternary ammonium compound can be a pyridinium salt such as those represented by Formula (I):

(I)

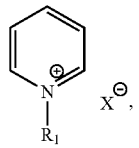

wherein $R_1$ is a $C_1$-$C_{18}$ alkyl group, an aryl group, or an arylalkyl group, and $X^-$ is chloride, bromide, or iodide. Among these compounds are alkyl pyridinium salts and alkyl pyridinium benzyl quats. Exemplary compounds include methyl pyridinium chloride, ethyl pyridinium chloride, propyl pyridinium chloride, butyl pyridinium chloride, octyl pyridinium chloride, decyl pyridinium chloride, lauryl pyridinium chloride, cetyl pyridinium chloride, benzyl pyridinium and a $C_1$-$C_6$ alkyl benzyl pyridinium chloride. Preferably, the pyridinium salt includes $C_1$-$C_6$ alkyl benzyl pyridinium chloride.

The quaternary ammonium compound can comprise an imidazolinium compound of Formula (II):

(II)

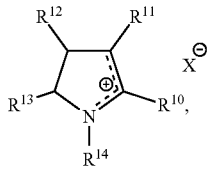

wherein $R^{10}$ is a $C_1$-$C_{20}$ alkyl or a $C_1$-$C_{20}$ alkoxyalkyl group; $R^{11}$ and $R^{14}$ are independently hydrogen, $C_1$-$C_6$ alkyl, $C_1$-$C_6$ hydroxyalkyl, or $C_1$-$C_6$ arylalkyl; $R^{12}$ and $R^{13}$ are independently a $C_1$-$C_6$ alkyl group or hydrogen; and $X^-$ is chloride, bromide, iodide, carbonate, sulfonate, phosphate, or the anion of an organic acid such as acetate. Preferably, the imidazolinium salt includes 1-benzyl-1-(2-hydroxyethyl)-2-tall-oil-2-imidazolinium chloride.

The cationic surfactant can for example comprise 2-alkyl-1-benzyl-1-(2-hydroxyethyl)-2-imidazolium chloride (e.g., $C_{12}$-, $C_{14}$-, $C_{16}$-, and/or $C_{18}$-alkyl-1-benzyl-1-(2-hydroxyethyl)-2-imidazolium chloride), N-benzylpyridinium chloride (e.g., N-benzyl-pyridinium chloride, N-benzyl $C_1$-$C_6$ alkyl pyridinium chloride, N-benzyl-picolinium chloride), ethoxylated tallow amine, or a combination thereof.

The cationic surfactant can for example comprise a mixture of 1-benzyl-1-(2-hydroxyethyl)-2-tall oil-2-imidazolinium chloride, N-benzyl-pyridinium chloride or N-benzyl $C_1$-$C_6$ alkyl pyridinium chloride, and ethoxylated tallow amine in about equal relative proportions, based on the total weight of the cationic surfactant.

In some embodiments, the surfactant(s), if included in the composition, is included at an amount of at least about 0.1 wt-% to about 20 wt-%, about 0.5 wt-% to about 20 wt-%, about 0.5 wt-% to about 10 wt-%, or about 0.5 wt-% to about 5 wt-%. In addition, without being limited according to the disclosure, all ranges recited are inclusive of the numbers defining the range and include each integer within the defined range.

Methods of Use

The methods of using the corrosion and metal wear inhibiting compositions beneficially control, i.e. reduces metal loss from the wear process as well as preventing corrosion. The compositions can be used in any industry where it is desirable to inhibit corrosion and wear-corrosion from a metal surface which comes in contact with the hydrocarbon fluid. However, this specifically results in significantly improve operations associated with recovery, transportation, refining or storage of hydrocarbon fluids. In particular, the methods of using the corrosion and metal wear inhibiting compositions can extend the lifetime of metal components, reduce downtime, reduce costs, increase sustainable operations, reduce carbon dioxide emissions, and/or reduce carbon footprints as the need to replace corroded and/or worn metal component(s) is significantly reduced.

The methods of using the corrosion and metal wear inhibiting compositions are particularly effective for reducing, inhibiting or preventing corrosion and metal loss from wear of a metal surface used in recovery, transportation, refining or storage of a hydrocarbon fluid, including hydrocarbon fluids containing elemental sulfur or polysulfide, including those systems having sour conditions (i.e., relatively high hydrogen sulfide concentration) while also being effective in sweet systems (i.e., systems having a relatively high carbon dioxide concentration).

Examples of metal surfaces include carbon steel conduits and pipelines. Various other metal surfaces benefit from the reduction in metal loss from the wear process as well as corrosion prevention. Exemplary metal surfaces can include apparatus that transport fluids from one point to another, such as an oil pipeline. The apparatus can be part of an oil refinery, such as a pipeline, a separation vessel, a dehydration unit, or the like. The composition can be introduced to large diameter flow lines of from about 1 inch to about 4 feet in diameter, small gathering lines, small flow lines and headers. The fluid can be contained in and/or exposed to an apparatus used in oil extraction and/or production, such as a wellhead. The apparatus can be part of a coal-fired power plant. The apparatus can be a cargo vessel, a storage vessel, a holding tank, or a pipeline connecting the tanks, vessels, or processing units. The fluid can be contained in water systems, condensate/oil systems/gas systems, or any combination thereof.

In preferred embodiments, the metal surface is used in recovery, transportation, refining or storage of the hydrocarbon fluid is under elevated carbon dioxide and elevated hydrogen sulfide causing high levels of metal loss and corrosion. Beneficially, the reduction, inhibition or prevention of metal wear provides a lubrication to the metal surface. Without being limited to a particular mechanism of action for providing lubrication to the metal surface, wear and friction is controlled by the introduction of a film comprised of organic molecules, and the addition of the film reduces friction between moving surfaces, e.g. case tubing and casing, in contact with each other.

The hydrocarbon fluid can be any type of liquid hydrocarbon including, but are not limited to, crude oil, heavy oil, processed residual oil, bituminous oil, coker oils, coker gas oils, fluid catalytic cracker feeds, gas oil, naphtha, fluid catalytic cracking slurry, diesel fuel, fuel oil, jet fuel, gasoline, and kerosene. The fluid can be a refined hydrocarbon product.

In some embodiments the hydrocarbon fluid can contain elemental sulfur, a polysulfide, or a combination thereof. The hydrocarbon fluid can contain 10, 20, 30, 40, 50, 60, 70, 80, 90, 100, 200, 300, 400, 500, 600, 700, 800, 900 1,000 or more ppm of elemental sulfur and/or 10, 20, 30, 40, 50, 60, 70, 80, 90, 100, 200, 300, 400, 500, 600, 700, 800, 900 1,000 or more ppm of a polysulfide.

The methods of using the corrosion and metal wear inhibiting compositions are useful in a wide range of climates and under a wide range of process conditions, including for example from about −40° C. to about 250° C., from about 0° C. to about 250° C., from about 40° C. to about 200° C.

The corrosion and metal wear inhibiting compositions can be at effective amount for either a continuous application, batch application, or a direct bath application to fully coat the metal surface. For example, the composition doses can be continuous to prevent corrosion and wear loss. The composition doses can also be intermittent (i.e., batch treatment). The composition doses can be continuous/maintained and/or intermittent to inhibit corrosion. In a continuous or batch/intermittent application for example, a concentration of about 25 ppm to about 100,000 ppm of the composition, about 50 ppm to about 10,000 ppm of the composition, about 50 ppm to about 5,000 ppm, or about 50 ppm to about 2,000 ppm of the composition in the fluid, such as a hydrocarbon fluid. In such applications of dosing, the flow rate of a flow line in which the composition is used can be between 0 and 100 feet per second, or between 0.1 and 50 feet per second. The compositions can be formulated with water in order to facilitate addition to the flow line.

Alternatively, the corrosion and metal wear inhibiting compositions can be applied at a direct batch application to fully coat the metal surface with a concentrate composition at a high concentration, such as between about 5,000 ppm to about 1,000,000 ppm for the metal surface to become oil wet. In some embodiments, a batch application introduces the composition, e.g. as a sphere or chemical plug to takes up the entire unit volume within a pipe or tubular, such as at a concentration up to about 1,000,000 ppm. In other embodiments, a batch treatment introduces an increased or higher concentration than a continuous dosing.

A fluid to which the compositions can be introduced can be an aqueous medium. The aqueous medium can comprise water, gas, and optionally liquid hydrocarbon. A fluid to which the compositions can be introduced can be a liquid hydrocarbon. Hydrocarbon fluids can comprise crude oil, heavy oil, processed residual oil, bituminous oil, coker oils, coker gas oils, fluid catalytic cracker feeds, gas oil, naphtha, fluid catalytic cracking slurry, diesel fuel, fuel oil, jet fuel, gasoline, kerosene, or combinations thereof. In preferred embodiments the hydrocarbon fluid is a refined hydrocarbon product.

The compositions can be introduced into a fluid by any appropriate method for ensuring dispersal through the fluid. The composition can be added at a point in a flow line upstream from the point at which corrosion prevention is desired. The compositions can be injected using mechanical equipment such as chemical injection pumps, piping tees, injection fittings, atomizers, quills, and the like.

The compositions can be pumped into an oil pipeline using an umbilical line. A capillary injection system can be used to deliver the composition to a selected fluid. The compositions can be introduced into a liquid and mixed. The fluid can be passed through an absorption tower comprising the composition.

The compositions can be added to a fluid at various levels of water cut. For example, the water cut can be from 0% to 100% volume/volume (v/v), from 1% to 80% v/v, or from 1% to 60% v/v. The fluid can be an aqueous medium that contains various levels of salinity. The fluid can have a salinity of 0% to 25%, about 1 to 24%, or about 10% to 25% weight/weight (w/w) total dissolved solids (TDS).

In some embodiments, the composition can be added to the hydrocarbon fluid before the hydrocarbon fluid contacts the metal surface.

In embodiments the methods of using the corrosion and metal wear inhibiting composition provide at least about a 25% wear metal loss rate reduction and wear-corrosion metal loss rate reduction, preferably at least about a 50% wear metal loss rate reduction and wear-corrosion metal loss rate reduction. In further embodiments the methods of using the corrosion and metal wear inhibiting composition provide at least about a 50% wear metal loss rate reduction and at least about a 60% wear-corrosion metal loss rate reduction.

Embodiments

The present disclosure is further defined by the following numbered paragraphs:

1. A method of reducing, inhibiting or preventing both corrosion and metal wear inhibition of a metal surface comprising: contacting a metal surface with a corrosion and metal wear inhibiting composition to reduce, inhibit or prevent both corrosion and metal wear of the metal surface, wherein the corrosion and metal wear inhibiting composition comprises: from about 2 wt-% to about 40 wt-% a carboxylic acid, a salt of a fatty acid amine condensate, and/or an alkanolamine or salt thereof, from about 1 wt-% to about 15 wt-% of an organic sulfur compound and/or an organic sulfonic acid amine, and from about 50 wt-% to about 90 wt-% of a solvent, and wherein the metal surface is used in recovery, transportation, refining or storage of a hydrocarbon fluid.

2. The method of paragraph 1, wherein the corrosion and metal wear inhibiting composition is added to the hydrocarbon fluid at a continuous concentration of about 50 to about 5,000 ppm, or as a direct batch application to fully coat the metal surface at a concentration of about 5,000 ppm to about 1,000,000 ppm.

3. The method of paragraph 3, wherein the corrosion and metal wear inhibiting composition is added to the hydrocarbon fluid before the hydrocarbon fluid contacts the metal surface.

4. The method of any one of paragraphs 1-3, wherein the hydrocarbon fluid comprises crude oil, heavy oil, processed residual oil, bituminous oil, coker oils, coker gas oils, fluid catalytic cracker feeds, gas oil, naphtha, fluid catalytic cracking slurry, diesel fuel, fuel oil, jet fuel, gasoline, kerosene, or combinations thereof.

5. The method of paragraph 4, wherein the hydrocarbon fluid is a refined hydrocarbon product.

6. The method of any one of paragraphs 1-5, wherein the metal surface comprises carbon steel.

7. The method of any one of paragraphs 1-6, wherein the metal surface used in recovery, transportation, refining or storage of the hydrocarbon fluid is under elevated carbon dioxide and elevated hydrogen sulfide causing high levels of metal loss and corrosion.

8. The method of any one of paragraphs 1-7, wherein the reduction, inhibition or prevention of metal wear provides a lubrication to the metal surface.

9. The method of any one of paragraphs 1-8, wherein the salt of the fatty acid amine condensate is a carboxylic acid-polyamine condensate.

10. The method of paragraph 9, wherein the carboxylic acid-polyamine condensate is an imidazoline.

11. The method of any one of paragraphs 1-9, wherein the salt of the fatty acid amine condensate is a reaction product of (1) a polyunsaturated fatty acid dimer, (2) a sulfonic acid compound, and (3) a reaction product of a polyalkylene polyamine, a tall oil fatty acid, and a polyunsaturated fatty acid dimer.

12. The method of paragraph 11, wherein the polyunsaturated fatty acid dimer comprises a linoleic acid dimer and the sulfonic acid compound comprises a linear alkyl benzene sulfonic acid.

13. The method of any one of paragraphs 1-12, wherein the alkanolamine salt is a dicarboxylic acid diethanolamine salt.

14. The method of any one of paragraphs 1-13, wherein the corrosion and metal wear inhibiting composition comprises from about 0.1 wt-% to about 10 wt-% a carboxylic acid, form about 1 wt-% to about 20 wt-% of a salt of a fatty acid amine condensate, and/or from about 1 wt-% to about 20 wt-% of an alkanolamine or salt thereof, or wherein the corrosion and metal wear inhibiting composition comprises from about 0.1 wt-% to about 10 wt-% a carboxylic acid, form about 1 wt-% to about 15 wt-% of a salt of a fatty acid amine condensate, and from about 1 wt-% to about 15 wt-% of an alkanolamine or salt thereof.

15. The method of any one of paragraphs 1-14, wherein the organic sulfur compound comprises a mercaptoalkyl alcohol, and wherein the solvent comprises water and/or an aromatic solvent.

16. The method of any one of paragraphs 1-15, wherein the corrosion and metal wear inhibiting composition further comprises one or more additives selected from the group consisting of additional corrosion inhibitors, corrosion inhibitor intensifiers, pH control additives, surfactants, gas hydrate inhibitors, scale inhibitors, clay stabilizers, bactericides, biocides, salt substitutes, relative permeability modifiers, hydrogen sulfide scavengers, oxygen scavengers, breakers, fluid loss control additives, asphaltene inhibitors, paraffin inhibitors, chelating agents, foaming agents, defoamers, emulsifiers, demulsifiers, iron control agents, friction reducers, drag reducing agents, flow improvers, viscosity reducers, solvents, and combinations thereof.

17. The method of paragraph 16, wherein the one or more additives is a substituted aromatic amine, a phosphoric acid ester, a quaternary ammonium compound, a solvent stabilizer compound comprising a glycol ether, a demulsifier comprising an oxyalkylate polymer, dodecylbenzylsulfonic acid, a salt of xylene sulfonic acid, epoxylated/propoxylated compound, phenolic and epoxide resin, or combinations thereof, at least one surfactant, or combinations thereof.

18. The method of paragraph 17, wherein the at least one surfactant comprises a cationic surfactant that is an alkoxylated alkyl amine and/or a quaternary ammonium compound, an anionic surfactant, a nonionic surfactant, or combinations thereof.

19. The method of any one of paragraphs 1-18, wherein the corrosion and metal wear inhibiting composition is substantially free of or free of pyrazine corrosion inhibitors.

20. The method of any one of paragraphs 1-19, wherein the method provides at least about a 25% wear metal loss rate reduction and wear-corrosion metal loss rate reduction, preferably at least about a 50% wear metal loss rate reduction and wear-corrosion metal loss rate reduction.

21. The method of any one of paragraphs 1-20, wherein the corrosion and metal wear inhibiting composition comprises from about 2 wt-% to about 40 wt-% of the carboxylic acid, salt of a fatty acid amine condensate, and/or an alkanolamine or salt thereof, from about 1 wt-% to about 15 wt-% of the organic sulfur compound and/or organic sulfonic acid amine, from about 50 wt-% to about 90 wt-% of the solvent(s), and from about 0 wt-% to about 40 wt-% of additional functional ingredients.

22. The method of any one of paragraphs 1-20, wherein the corrosion and metal wear inhibiting composition comprises from about 2 wt-% to about 30 wt-% of the carboxylic acid, salt of a fatty acid amine condensate, and/or an alkanolamine or salt thereof, from about 1 wt-% to about 10 wt-% of the organic sulfur compound and/or organic sulfonic acid amine, from about 60 wt-% to about 90 wt-% of the solvent(s), and from about 0 wt-% to about 20 wt-% of additional functional ingredients.

23. The method of any one of paragraphs 1-20, wherein the corrosion and metal wear inhibiting composition comprises from about 2 wt-% to about 20 wt-% of the carboxylic acid, salt of a fatty acid amine condensate, and/or an alkanolamine or salt thereof, from about 2 wt-% to about 10 wt-% of the organic sulfur compound and/or organic sulfonic acid amine, from about 70 wt-% to about 90 wt-% of the solvent(s), and from about 0 wt-% to about 10 wt-% of additional functional ingredients.

EXAMPLES

Embodiments of the present disclosure are further defined in the following non-limiting Examples. It should be understood that these Examples, while indicating certain embodiments of the disclosure, are given by way of illustration only. From the above discussion and these Examples, one skilled in the art can ascertain the essential characteristics of this disclosure, and without departing from the spirit and scope thereof, can make various changes and modifications of the embodiments of the disclosure to adapt it to various usages and conditions. Thus, various modifications of the embodiments of the disclosure, in addition to those shown and described herein, will be apparent to those skilled in the art from the foregoing description. Such modifications are also intended to fall within the scope of the appended claims.

The following exemplary corrosion and metal wear inhibiting composition was utilized in the Examples:

TABLE 2

| Test Composition | Wt-% |
|---|---|
| 2-mercaptoethanol | 2-4 |
| Morpholine dodecylbenzenesulfonate | 2-4 |
| 2-cyclohexene-1-octanoic acid, 5(or 6)-carboxy-4-hexyl-, compd. With 2,2'iminobis(ethanol) | 2-4 |
| RX prod of (polyalkylenepolyamine & TOFA & linoleic acid dimer) compds. with DDBSA & linoleic acid dimer | 1-3 |
| Naphthenic acid reaction products with Diethylenetriamine and Tall Oil Fatty Acids (Imidazoline) | 1-3 |
| 5(or 6)-carboxy-4-hexyl-2-cyclohexene-octanoic acid | <1 |
| Oxyalkylate polymer (Demulsifier) | 1-3 |
| Solvents | Remainder |

Example 1

Laboratory testing to evaluate an exemplary corrosion and metal wear inhibiting composition ("Test Composition") as shown in Table 2 was performed to assess corrosion reduction, wear-corrosion reduction, and wear reduction on metal alloys typically used in the oil and gas industry. Various concentrations of the Test Composition were tested under different corrosive environments. Wear and corrosion analysis was performed through mass loss measurements according to the following test methodology.

Coupon and Preparation

L-80 steel alloy coupons with 1% chromium were evaluated (size 24 mm×56 mm×3 mm approximate). The surface of the coupon was lapped to give a cross hatched pattern with surface roughness of 30 Ra. Two holes were drilled to mount the coupon to the test rig. A new L80 coupon was used for each test. The same zirconia oxide pin was used for all tests, as the ceramic material did not exhibit wear.

Before the test, the coupon was cleaned and de-greased in hexane, and placed in an ultrasonic bath for 20 minutes at 30° C. After cleaning, the coupons were weighed, and imaged with an optical microscope. All but one surface of the coupon was coated with MICRStop® lacquer paint, which is resistant to elevated temperatures and certain chemicals and then placed in an oven at 40° C. to cure for about three hours before being placed in the testing chamber. After exposure to the test environment, the test coupon was removed and the lacquer paint was removed in an ultrasonic bath with acetone before being cleaned with Clarke's Solution to remove surface films before being rinsed, dried and re-weighed to determine the mass loss and metal loss rate.

Counter Specimen to Impart Wear

The counter specimen used for this study was a zirconium oxide pin that was machined to a 6 mm diameter×15 mm.

Test Brine

Distilled water with following ions (approximate): 85,000 mg L-1 sodium, 1,250 mg L-1 magnesium, 17,250 mg L-1 calcium, 2,100 mg L-1 strontium, 30 mg L-1 barium, and 170,000 mg L-1 chloride.

Hydrocarbon

No hydrocarbon was used in the tests.

Chemical Application

For simulated continuous corrosion inhibitor application, the Test Composition was injected by means of a syringe at an appropriate volume to achieve a designated concentration (ppm) in the brine to simulate a continuous corrosion inhibitor application.

For simulated batch corrosion inhibitor application, a "dip and drip" method approach was used in which the coupon was dipped into the concentration inhibitor for 5 seconds and then hung to allow to drip for 15 minutes to allow excess chemical inhibitor to run off the surface of the coupon before the coupon was placed into the test chamber.

Testing Chamber and Set-Up

A Plint TE-77 reciprocating tribometer, fitted with a sealed chamber, and a closed, recirculating fluid loop and gas system to control the test environment. The Plint TE-77 reciprocating tribometer with enclosed environmental chamber was designed with appropriate tubing (PTFE or stainless steel), seals, pump to support fluid and gas circulation, and gas pressurization was used.

The L-80 (with 1% Cr) coupon was housed within the testing chamber on which a zirconium oxide pin was moved backwards and forwards at a speed of 3 Hz and 20 mm stroke length with a 30 N load to impart wear to the steel surface. The brine was deaerated with inert nitrogen gas when a wear only assessment was conducted or with carbon dioxide when either a wear-corrosion test was being performed under otherwise the same conditions or in the absence of the imparted load to assess the corrosion only process.

An Orbisphere 3100 portable oxygen analyzer was used to measure the dissolved oxygen content of the fluid. The target oxygen concentration for each test was ~20 ppb.

All tests were performed at 50° C. at 20 psi for 24 hrs. The steel coupon was weighed before and after exposure to determine the metal loss (and metal loss rate) from wear, corrosion or combined wear-corrosion. All tests were performed in the absence of chemical and then repeated with the Test Composition under otherwise the same conditions and the amount of metal loss compared.

Summary of Test Conditions

A summary of test conditions is shown in Tables 3 and 4.

TABLE 3

| Test # | Test Type | Fluid | Chemical | Chemical Conc. [ppm] | De-aeration Gas | Test Gas | $O_2$ Content [ppb] | Load [N] |
|---|---|---|---|---|---|---|---|---|
| 1 | Wear | Brine | NA | 0 | $N_2$ | $N_2$ | 18.4 | 30 |
| 2 | wear-corrosion | Brine | NA | 0 | $N_2$ | $CO_2$ | 19.6 | 30 |
| 3 | corrosion | Brine | NA | 0 | $N_2$ | $CO_2$ | 20.1 | 0 |
| 4 | wear-corrosion | Brine | Test Composition | 5000 | $N_2$ | $CO_2$ | 19.2 | 30 |
| 5 | corrosion | Brine | Test Composition | 5000 | $N_2$ | $CO_2$ | 20.4 | 0 |
| 6 | Wear | Brine | Test Composition | 5000 | $N_2$ | $N_2$ | 18.8 | 30 |
| 7 | corrosion | Brine | Test Composition | 5000 | $CO_2$ | $CO_2$ | 19.1 | 0 |
| 8 | corrosion | Brine | NA | 0 | $CO_2$ | $CO_2$ | 20.2 | 0 |
| 9 | wear-corrosion | Brine | NA | 0 | $CO_2$ | $CO_2$ | 20.4 | 30 |
| 10 | wear-corrosion | Brine | Test Composition | 5000 | $CO_2$ | $CO_2$ | 20.6 | 30 |
| 11 | wear-corrosion | Brine | Test Composition | 500 | $CO_2$ | $CO_2$ | 21.2 | 30 |
| 12 | wear-corrosion | Brine | Test Composition | 500 | $CO_2$ | $CO_2$ | 23.4 | 30 |
| 13 | wear-corrosion | Brine | Test Composition | 50 | $CO_2$ | $CO_2$ | 22.6 | 30 |
| 14 | wear-corrosion | Brine | Test Composition | 50 | $CO_2$ | $CO_2$ | 21.8 | 30 |
| 15 | wear-corrosion | Brine | Test Composition | Dip/Drip | $CO_2$ | $CO_2$ | 21.4 | 30 |
| 16 | wear-corrosion | Brine | Test Composition | Dip/Drip | $CO_2$ | $CO_2$ | 22.4 | 30 |

TABLE 4

| Parameter | Value |
|---|---|
| Temperature | 50 °C |
| Load | 0 or 30N |
| Speed | 3 Hz |
| Stroke length | 20 mm |
| Time | 24 h |
| Pressure | 20 psi |
| Deaeration and test gas | Carbon dioxide or nitrogen |

The "wear" test consisted of: 30N load and $N_2$ environment.

The "corrosion" test consisted of: 0N load—the reciprocating arm (with the zirconium oxide pin still attached but positioned about 2 mm above the coupon without contact) was moved at the same speed and stroke length so the same movement/fluid agitation was employed but without any load, and $CO_2$ environment.

The "wear-corrosion" test consisted of: 30N load and $CO_2$ environment.

Results

The results show the use of a corrosion and metal wear inhibiting composition as described herein beneficially controls, i.e. reduces metal loss from the wear process as well as preventing corrosion (confirming efficacy in wear-corrosion reduction) both at various dose rates simulating continuous injection and via batch application.

The mils penetration per year (MPY) is used as an estimated corrosion rate. The MPY was calculated from the following equation:

$$MPY = (\Delta M[\mathrm{g}] \cdot C) / \left(\rho\left[\frac{\mathrm{g}}{\mathrm{cm}^2}\right] \cdot A[\mathrm{in}^2] \cdot \mathrm{t}[\mathrm{hr}]\right)$$

where ΔM is the mass loss of the coupon at the end of the test in grams, C is a constant equal to 534000, ρ is the density of the coupon in g/cm2, A is the surface area of the coupon in cm2, and t is the exposure time in hours. For L80 steel, the density is 7.86 g/cm$^3$. The surface area was measured by optical microscope for each coupon. Since the back and side surfaces were coated in either epoxy or lacquer, only the top surface area was included in the calculation. From the MPY for specific test types and de-aeration gases, an inhibition percentage was calculated to show the effect of the chemical treatment.

The % Metal Loss Rate Inhibition was determined as a percentage of the reduced metal loss rate in the presence of the Test Composition compared with that of the blank (no chemical present) carried out under otherwise the same conditions. The results show significant metal loss from the wear only process (without corrosion) in which 5,000 ppm Test Composition demonstrated a wear metal loss rate reduction of about 59%.

Under blank conditions in the absence of the Test Composition, the results show a synergistic effect of wear in conjunction with corrosion where the overall wear-corrosion metal rate loss was greater than the sum of the individual metal rate losses from the individual processes. The Test Composition demonstrated a wear-corrosion metal loss rate reduction of about 69% when injected at 50 ppm and a wear-corrosion metal loss rate reduction of about 74% when applied via a batch dip and drip approach compared with the blank, chemical untreated conditions.

The summary of results is shown in Table 5 for mass loss measurements, where tests 1 and 2 using $N_2$ as the de-aeration gas is a comparison to assess the wear mechanism without corrosion.

TABLE 5

| Test | | Chemical Conc. | De-aeration | Coupon Mass [g] | | | Coupon Area | | Metal Loss Rate | Inhibition |
|---|---|---|---|---|---|---|---|---|---|---|
| # | Test Type | [ppm] | Gas | Before | After | Difference, ΔM | [in$^2$] | [mm$^2$] | [MPY] | [%] |
| 1 | Wear | 0 | $N_2$ | 30.0252 | 30.0208 | 0.0044 | 2.022 | 1304.26 | 6.16 | 0 |
| 2 | Wear | 5000 | $N_2$ | 31.1898 | 31.188 | 0.0018 | 2.021 | 1303.74 | 2.52 | 59.07 |
| 3 | corrosion | 5000 | $CO_2$ | 30.9159 | 30.9135 | 0.0024 | 2.033 | 1311.86 | 3.34 | 31.46 |
| 4 | corrosion | 0 | $CO_2$ | 30.4229 | 30.4194 | 0.0035 | 2.032 | 1311.24 | 4.87 | 0 |
| 5 | corrosion, wear | 0 | $CO_2$ | 30.8642 | 30.8528 | 0.0114 | 2.014 | 1299.24 | 16.02 | 0 |
| 6 | corrosion, wear | 5000 | $CO_2$ | 31.2636 | 31.2591 | 0.0045 | 2.006 | 1294.37 | 6.35 | 60.38 |
| 7 | corrosion, wear | 500 | $CO_2$ | 31.0953 | 31.092 | 0.0033 | 2.028 | 1308.57 | 4.61 | 71.26 |
| 8 | corrosion, wear | 500 | $CO_2$ | 30.3169 | 30.3134 | 0.0035 | 1.977 | 1275.80 | 5.01 | 68.73 |
| 9 | corrosion, wear | 50 | $CO_2$ | 30.4666 | 30.4631 | 0.0035 | 2.025 | 1306.46 | 4.89 | 69.47 |
| 10 | corrosion, wear | 50 | $CO_2$ | 30.3147 | 30.3104 | 0.0043 | 2.026 | 1307.10 | 6.01 | 62.51 |
| 11 | corrosion, wear | Dip/Drip | $CO_2$ | 30.6556 | 30.6526 | 0.003 | 2.025 | 1307.49 | 4.19 | 73.83 |
| 12 | corrosion, wear | Dip/Drip | $CO_2$ | 30.5565 | 30.5531 | 0.0034 | 2.026 | 1299.66 | 4.75 | 70.35 |

The summary of results is shown in Table 6 for wear measurements using a Bruker NPFLEX-LA interferometer. This analysis provided 3D wear depth and volume.

TABLE 6

| Test # | Test Type | Chemical Conc. [ppm] | De-aeration Gas | Depth [um] | Wear Volume [$um^3$] | Wear Volume × 10^6 [$um^3$] | Wear Inhibition [%] |
|---|---|---|---|---|---|---|---|
| 1 | corrosion, wear | 0 | $CO_2$ | 2.2177 | 246923149.3 | 246.92 | 0 |
| 2 | corrosion, wear | 5000 | $CO_2$ | 1.8903 | 194999173.1 | 195.00 | 21.03 |
| 3 | corrosion, wear | 500 | $CO_2$ | 2.3659 | 281714098.2 | 281.71 | −14.09 |
| 4 | corrosion, wear | 500 | $CO_2$ | 2.1624 | 84606820.35 | 84.61 | 65.74 |
| 5 | corrosion, wear | 50 | $CO_2$ | 2.694 | 153351847.9 | 153.35 | 37.89 |
| 6 | corrosion, wear | 50 | $CO_2$ | 2.794 | 246119989.2 | 246.12 | 0.33 |
| 7 | corrosion, wear | Dip/Drip | $CO_2$ | 2.7153 | 150630694.9 | 150.63 | 39.00 |
| 8 | corrosion, wear | Dip/Drip | $CO_2$ | 3.879 | 201258139.6 | 201.26 | 18.49 |

The results in Table 6 have repeat runs at conditions of 500 ppm and 50 ppm, showing the wear inhibition. These results indicate the use of the corrosion and metal wear inhibiting compositions can significantly improve operations associated with recovery, transportation, refining or storage of hydrocarbon fluids by extending the lifetime of metal components, reducing downtime, reducing costs, increasing sustainable operations, reducing carbon dioxide emissions, and/or reducing carbon footprints as the need to replace corroded and/or worn metal component(s) is reduced.

It is to be understood that while the invention has been described in conjunction with the detailed description thereof, the foregoing description is intended to illustrate, and not limit the scope of the invention, which is defined by the scope of the appended claims. Other embodiments, advantages, and modifications are within the scope of the following claims. Any reference to accompanying drawings which form a part hereof, are shown, by way of illustration only. It is understood that other embodiments may be utilized and structural changes may be made without departing from the scope of the present disclosure. All publications discussed and/or referenced herein are incorporated herein in their entirety. The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

What is claimed is:

1. A method of reducing, inhibiting or preventing both corrosion and metal wear inhibition of a metal surface comprising:

contacting a metal surface with a corrosion and metal wear inhibiting composition via a fluid to reduce, inhibit or prevent both corrosion and metal wear of the metal surface, wherein the corrosion and metal wear inhibiting composition comprises:

from about 2 wt-% to about 40 wt-% of a carboxylic acid, a salt of a fatty acid amine condensate, and/or an alkanolamine or salt thereof, from about 1 wt-% to about 15 wt-% of a mercaptoalkyl alcohol, and from about 50 wt-% to about 90 wt-% of a solvent, and wherein the metal surface is used in recovery, transportation, refining or storage of a hydrocarbon fluid; and wherein the method provides at least about a 50% wear metal loss rate reduction and wear-corrosion metal loss rate reduction.

2. The method of claim 1, wherein the corrosion and metal wear inhibiting composition is added to the hydrocarbon fluid at a continuous concentration of about 50 to about 5,000 ppm, or as a direct batch application to fully coat the metal surface at a concentration of about 5,000 ppm to about 1,000,000 ppm.

3. The method of claim 1, wherein the corrosion and metal wear inhibiting composition is added to the hydrocarbon fluid before the hydrocarbon fluid contacts the metal surface.

4. The method of claim 1, wherein the hydrocarbon fluid comprises crude oil, heavy oil, processed residual oil, bituminous oil, coker oils, coker gas oils, fluid catalytic cracker feeds, gas oil, naphtha, fluid catalytic cracking slurry, diesel fuel, fuel oil, jet fuel, gasoline, kerosene, or combinations thereof.

5. The method of claim 4, wherein the hydrocarbon fluid is a refined hydrocarbon product.

6. The method of claim 1, wherein the metal surface comprises carbon steel.

7. The method of claim 1, wherein the metal surface used in recovery, transportation, refining or storage of the hydrocarbon fluid is under elevated carbon dioxide and elevated hydrogen sulfide causing high levels of metal loss and corrosion.

8. The method of claim 1, wherein the reduction, inhibition or prevention of metal wear provides a lubrication to the metal surface.

9. The method of claim 1, wherein the salt of the fatty acid amine condensate is a carboxylic acid-polyamine condensate.

10. The method of claim 9, wherein the carboxylic acid-polyamine condensate is an imidazoline.

11. The method of claim 1, wherein the salt of the fatty acid amine condensate is a reaction product of (1) a polyunsaturated fatty acid dimer, (2) a sulfonic acid compound, and (3) a reaction product of a polyalkylene polyamine, a tall oil fatty acid, and a polyunsaturated fatty acid dimer.

12. The method of claim 11, wherein the polyunsaturated fatty acid dimer comprises a linoleic acid dimer and the sulfonic acid compound comprises a linear alkyl benzene sulfonic acid.

13. The method of claim 1, wherein the alkanolamine salt is a dicarboxylic acid diethanolamine salt.

14. The method of claim 1, wherein the solvent comprises water and/or an aromatic solvent.

15. The method of claim 1, wherein the corrosion and metal wear inhibiting composition further comprises one or more additives selected from the group consisting of additional corrosion inhibitors, corrosion inhibitor intensifiers, pH control additives, surfactants, gas hydrate inhibitors, scale inhibitors, clay stabilizers, bactericides, biocides, salt substitutes, relative permeability modifiers, hydrogen sulfide scavengers, oxygen scavengers, breakers, fluid loss control additives, asphaltene inhibitors, paraffin inhibitors, chelating agents, foaming agents, defoamers, emulsifiers, demulsifiers, iron control agents, friction reducers, drag reducing agents, flow improvers, viscosity reducers, solvents, and combinations thereof.

16. The method of claim 15, wherein the one or more additives is a substituted aromatic amine, a phosphoric acid ester, a quaternary ammonium compound, a solvent stabilizer compound comprising a glycol ether, a demulsifier comprising an oxyalkylate polymer, dodecylbenzylsulfonic acid, a salt of xylene sulfonic acid, epoxylated/propoxylated compound, phenolic and epoxide resin, or combinations thereof, at least one surfactant, or combinations thereof.

17. The method of claim 16, wherein the at least one surfactant comprises a cationic surfactant that is an alkoxylated alkyl amine and/or a quaternary ammonium compound, an anionic surfactant, a nonionic surfactant, or combinations thereof.

18. The method of claim 1, wherein the corrosion and metal wear inhibiting composition is substantially free of or free of pyrazine corrosion inhibitors.

* * * * *